United States Patent [19]

Kurobe et al.

[11] 4,177,875

[45] Dec. 11, 1979

[54] MUFFLER FOR INTERNAL COMBUSTION ENGINE

[75] Inventors: Takao Kurobe; Katsuziro Tachikawa; Tetsuo Kato; Yoshinobu Imatoku, all of Aichi, Japan

[73] Assignees: Toyota Jidosha Kogyo Kabushiki Kaisha; Kabushiki Kaisha Sango; Futaba Sangyo Kabushiki Kaisha, all of Aichi, Japan

[21] Appl. No.: 866,828

[22] Filed: Jan. 4, 1978

[30] Foreign Application Priority Data

Aug. 15, 1977 [JP] Japan ..... 52/97020

[51] Int. Cl.[2] ..... F01N 1/08

[52] U.S. Cl. ..... 181/265; 181/266; 181/272; 181/273; 181/276

[58] Field of Search ..... 181/238, 264, 266, 268, 181/269, 272, 273, 275, 276, 282, 239, 240, 265, 267, 270, 271

[56] References Cited

U.S. PATENT DOCUMENTS

| | | | |
|---|---|---|---|
| 2,618,354 | 11/1952 | Hedrick | 181/266 |
| 2,707,525 | 5/1955 | Janeway | 181/268 |
| 2,950,777 | 8/1960 | Deremer | 181/266 |
| 3,016,972 | 1/1962 | Dugas | 181/268 |
| 3,103,256 | 9/1963 | Deremer | 181/266 |
| 3,512,607 | 5/1970 | Hubbell | 181/265 |
| 3,613,830 | 10/1971 | Hubbell | 181/266 |
| 3,841,841 | 10/1974 | Torosian et al. | 181/238 |

FOREIGN PATENT DOCUMENTS

| | | | |
|---|---|---|---|
| 601321 | 7/1960 | Canada | 181/272 |

*Primary Examiner*—L. T. Hix
*Assistant Examiner*—Benjamin R. Fuller
*Attorney, Agent, or Firm*—Toren, McGeady and Stanger

[57] ABSTRACT

A muffler for an internal combustion engine includes a cylindrical casing having end plates closing the interior thereof. At least one baffle extending perpendicularly to the central axis of the casing is provided for dividing the interior of the casing into a front chamber and a tuning chamber. A tuning tube extending through the baffle places the front chamber into flow communication with the tuning chamber, and at least one exhaust gas inlet pipe extends into the front chamber through one of the end plates in coaxial relationship with the tuning tube. At least one exhaust gas outlet pipe is provided through the one end plate in parallel relationship with the inlet pipe. Furthermore, one or more openings are provided in the baffle in coaxial relation to the exhaust gas outlet pipe.

2 Claims, 9 Drawing Figures

MUFFLER FOR INTERNAL COMBUSTION ENGINE

BACKGROUND OF THE INVENTION

The present invention relates generally to mufflers particularly for use in the exhaust system of an internal combustion engine. More specifically, the invention is directed to a muffler having a low frequency resonance chamber.

Mufflers having a low frequency tuning chamber provided in the exhaust systems of passenger automobiles are used for efficiently damping exhaust noise in the low frequency range such as, for example, booming noise. However, in prior art devices having low frequency tuning chambers it has been found that damping of exhaust noise cannot be achieved over a wide range of frequencies.

Accordingly a principal aim of the present invention is to provide a muffler for an internal combustion engine which will efficiently damp exhaust noise over a wider range of frequencies.

SUMMARY OF THE INVENTION

According to the present invention, there is provided a muffler for internal combustion engines, which comprises: a cylindrical casing having a pair of ends closing the interior of the casing; at least one baffle extending perpendicularly to the central axis of the casing dividing the interior of the casing into a front chamber and a tuning chamber; a tuning tube extending through the baffle and bringing the front chamber into flow communication with the tuning chamber; at least one exhaust gas inlet pipe extending into the front chamber through one of the end plates in coaxial relationship with the tuning tube; and at least one exhaust gas outlet pipe extending through the said one end plate parallel with the inlet pipe. One or more openings in the baffle in coaxial relationship with the exhaust gas outlet pipe may, for example, be in the form of a burring hole provided by directly applying a burring operation to the baffle. Alternatively, the openings may comprise a plurality of punch holes or louvers.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
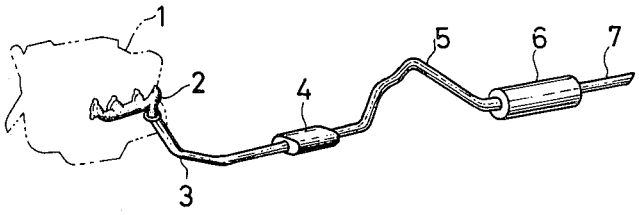
FIG. 1 is a schematic outline of an exhaust system.

Referring to FIG. 1, an exhaust manifold 2 in an internal combustion engine 1 is connected via a front pipe to a sub-muffler or a catalytic converter 4, which in turn is connected via a central pipe 5 to a muffler 6, the outlet of which is connected to a tail pipe 7. Exhaust noise developed in the engine and delivered through the exhaust manifold 2 is damped in the sub-muffler or catalytic converter 4, and then further damped in the muffler 6.

Figure 2:
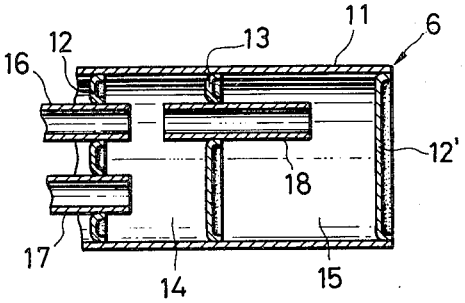
FIG. 2 PRIOR ART
FIG. 2 is a longitudinal cross-sectional view of a prior art resonance-type muffler.

FIG. 2 shows part of the muffler 6 having a prior art tuning chamber. The muffler includes a cylindricalcasing 11, end plates 12, 12' closing the open ends of the cylindrical case 11 and a baffle 13 provided in the casing 11 extending perpendicularly to the central axis of the casing and dividing the interior of the casing into two chambers 14 and 15. The chamber 14 is used as a front chamber, while the chamber 15 serves as a tuning chamber.

An inlet pipe 16 and an outlet pipe 17 extend through the one of the end plates 12, while a tuning tube 18 extends through the baffle 13 in coaxial relationship with the inlet pipe 16. The tuning tube 18 and the tuning chamber 15 constitute a resonator.

The resonance frequency of the device is dependent upon the length and the open cross-sectional area of the tuning tube, and upon the volume of the tuning chamber 15. The exhaust noise which is directed through the inlet pipe 16 into the front chamber 14 is damped by means of the resonator consisting of the tuning tube 18 and the tuning chamber 15. Noise is then emitted from the outlet pipe 17.

Figure 3:
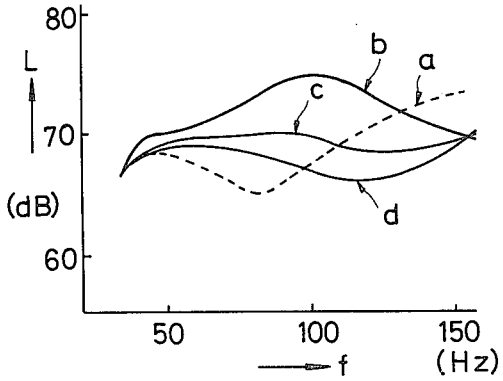
FIG. 3 is a graphic representation of an exhaust noise damping characteristics.

FIG. 3 shows the exhaust noise characteristics of a resonance-type muffler. An explosion primary frequency f (Hz) for an internal combustion engine is represented by the abscissa, while sound pressure level L (dB) is represented by the ordinate. In this respect, frequencies in the range of from about 60 to 110 Hz are likely to cause a booming noise at the mediate speed while frequencies in the range of from about 110 to 170 Hz are likely to cause a booming noise at the high speed. With a muffler having a tuning chamber as shown in FIG. 2, in a case where the resonance frequency is so set (about 80 Hz) that exhaust noise of frequencies which are likely to cause the booming noise at the mediate speed may be principally damped, then as shown by a curve a in FIG. 3, the damping characteristics is such that booming noise at the mediate speed is further lowered as compared with a muffler devoid of a tuning chamber such as is shown in curve b.

However in a case where the resonance frequency is so selected (about 120 Hz) that exhaust noise having frequencies which tend to cause booming noise at the high speed may be principally damped, than as shown by a curve c, there results insufficient damping of exhaust noise of a frequency causing booming noise, at the mediate speed and even small damping of noise of a resonant frequency.

The muffler according to the present invention is directed toward avoiding these shortcomings by damping exhaust noise over a wider range of frequencies.

Figure 4:
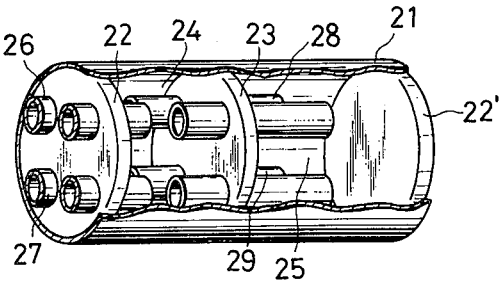
FIG. 4 is a perspective view, partly broken, of the first embodiment of the invention.
Figure 5:
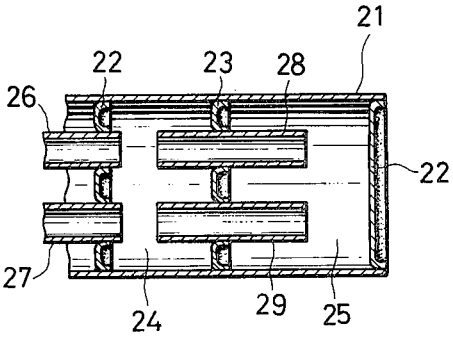
FIG. 5 is a longitudinal cross-sectional view of the first embodiment of FIG. 4.

FIGS. 4 and 5 depict a muffler according to the present invention. A cylindrical casing 21 has open ends which are closed with end plates 22, 22'. The interior of the casing 21 is divided by a baffle 23 into two chambers 24, 25. In this respect, the baffle 23 is provided perpendicularly to the central axis of the casing 21. An inlet pipe 26 and an outlet pipe 27 extend through the end plate 22 in parallel with the central axis of the casing. A first tuning tube 28 and a second tuning tube 29 extend through the baffle 23 in coaxial relationship with the pipes 26 and 27, respectively. The chamber 24 is used as a front chamber, while the chamber 25 serves as a tuning chamber and constitutes a resonator in cooperation with the tuning tubes 28 and 29.

Exhaust noise directed through the inlet pipe 26 into the front chamber 24 is damped by the resonator consisting of the tuning tubes 28, 29 and tuning chamber 25, and then exits from the outlet pipe 27. A curve d in FIG. 3 represents the exhaust noise damping characteristic of the muffler of the arrangement described. As best shown therein, exhaust sound may be damped over a wide range of frequencies. In addition, if a relatively high resonance frequency is selected, then even exhaust noise of a high frequency such as might produce a booming noise at the high speed may be efficiently damped, unlike the muffler (curve c) having a single tuning tube.

Figure 6:
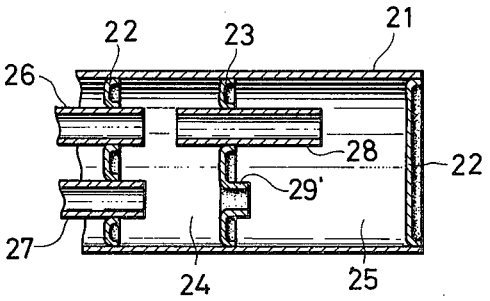
FIGS. 6 and 7 are longitudinal cross-sectional views of the second and third embodiments of the invention.

FIG. 6 shows a modification of the second tuning tube, in which a burring hole 29' is provided in the baffle 23.

Figure 7:
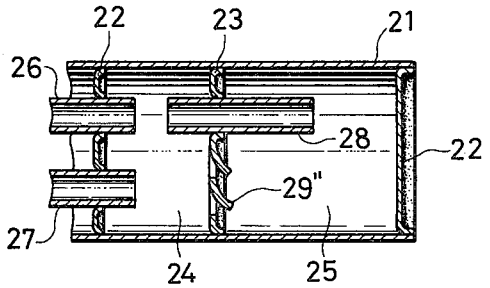

FIG. 7 shows another modification of the second tuning tube, in which a plurality of louvers 29'' are formed in the baffle 23.

Figure 8:
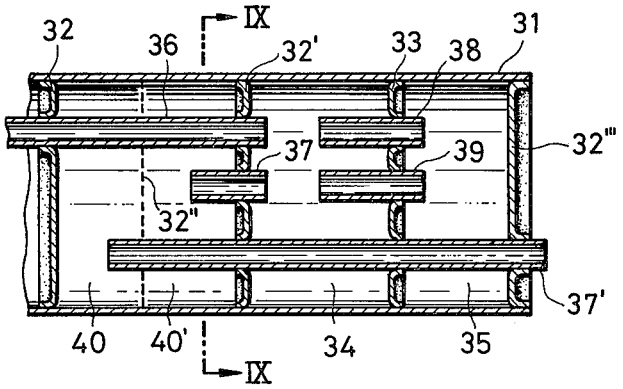
FIG. 8 is a longitudinal cross-sectional view of the fourth embodiment of the invention.
Figure 9:
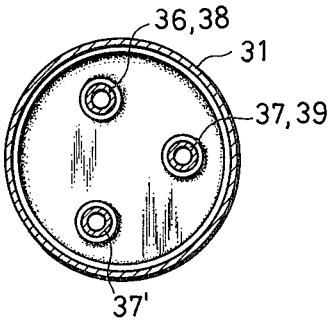
FIG. 9 is transverse cross-sectional view of the fourth embodiment, taken along the line IX—IX of FIG. 8.

FIGS. 8 and 9 show another muffler assembly, in which a cylindrical casing 31 has open ends which are closed with end plates 32, 32'''. The interior of the casing 31 is divided by baffles 32'', 32' and 33 into first, second, third and fourth chambers 40, 40', 34 and 35, while the baffles 32'', 32' and 33 are provided therein at a right angle to the center axis of the case. The baffle 32'' is made of a perforated plate or mesh. An inlet pipe 36 opens into the chamber 34. The inlet pipe 36 extends through end wall 32, and through baffles 32'', 32'. A pipe 37 extends through the end plate 32'. A first tuning tube 38 and a second tuning tube 39 extend through the baffle 33 in coaxial relationship with the pipes 36, 37. The chamber 35 serves as a tuning chamber and constitutes a resonator in cooperation with the two tuning tubes 38, 39. An outlet pipe 37' extends through baffles 32'', 32', 33, thereby bringing the first chamber 40 into flow communication with the exterior of the case 31.

Exhaust noise directed through the inlet pipe 36 into the front or third chamber 34 may be damped by the resonator consisting of the tuning tubes 38, 39 and tuning chamber 35, and then passed through the pipe 37 into the first and second chambers 40, 40', wherein the exhaust noise is further damped. The noise is then emitted from the outlet pipe 37'.

As is apparent from the foregoing description of the muffler according to the invention, exhaust noise may be efficiently damped over a wider range of frequencies covering the booming frequencies at the mediate speed to the high speed.

While specific embodiments of the invention have been shown and described in detail to illustrate the application of the inventive principles, it will be understood that the invention may be embodied otherwise without departing from such principles.

What is claimed is:

1. A muffler assembly for an internal combustion engine comprising: a generally cylindrical casing having a pair of end plates closing the interior of said casing and a central axis extending longitudinally thereof; a baffle plate located intermediate said end plates and extending across the interior of said casing in a plane generally perpendicular to said central axis; a front chamber defined between one of said end plates and said baffle plate; a tuning chamber defined between the other of said end plates and said baffle plate; an exhaust gas inlet extending through said one end plate in a direction generally parallel to said central axis, said inlet pipe being in direct flow communication between the exterior of said casing and said front chamber to deliver exhaust gases into said front chamber; an exhaust gas outlet pipe extending through said one end plate through which said inlet pipe extends in a direction parallel to said inlet pipe, said outlet pipe being in direct flow communication between said front chamber and the exterior of said casing to discharge exhaust gases from said front chamber; first tuning means consisting essentially of a tuning tube extending through said baffle plate in direct flow communication between said front chamber and said tuning chamber, said tuning tube being in direct coaxial alignment with said inlet pipe across said front chamber and extending generally parallel to said central axis; and second tuning means defining a gas flow path extending through said baffle plate between said tuning chamber and said front chamber, and gas flow path being in direct coaxial alignment with said outlet pipe across said front chamber.

2. A muffler assembly for an internal combustion engine, comprising: a generally cylindrical casing including a first and a second end plate closing the interior of said casing and a central axis extending longitudinally thereof; a first, a second and a third baffle plate each extending across the interior of said casing generally parallel to each other and perpendicular to said central axis; a first chamber defined between said first end plate and said first baffle plate; a second chamber defined between said first baffle plate and said second baffle plate; a third chamber defined between said second baffle plate and said third baffle plate; a fourth chamber defined between said third baffle plate and said second end wall; an exhaust gas inlet pipe generally parallel to said central axis extending continuously through said first end plate, said first baffle plate and said second baffle plate in direct flow communication between the exterior of said casing and said third chamber for delivering exhaust gases into said third chamber; an exhaust gas outlet pipe generally parallel to said central axis extending continuously through said first, said second and said third baffle plates and through said second end plate in direct flow communication between said first chamber and the exterior of said casing for discharging exhaust gases from said first chamber; a first tuning tube generally parallel to said central axis extending through said third baffle plate in direct flow communication between said third and said fourth chambers, said first tuning tube being aligned in direct coaxial relationship across said third chamber with said inlet pipe; a second tuning tube extending through said third baffle plate in direct flow communication between said third and said fourth chambers, said second tuning tube being generally parallel with each of said inlet pipe, said exhaust pipe and said first tuning tube and being axially displaced therefrom; and a third tube extending through said second baffle plate in direct flow communication between said second chamber and said third chamber, said third tube being generally parallel to said central axis and aligned in direct coaxial relationship with said second tuning tube across said third chamber.

* * * * *